US006639344B2

(12) United States Patent
Bucher et al.

(10) Patent No.: US 6,639,344 B2
(45) Date of Patent: Oct. 28, 2003

(54) CATHODE RAY TUBE HAVING A FOCUS MASK AND SUPPORT FRAME ASSEMBLY WITH AN IMPROVED BORDER

(75) Inventors: Alan Weir Bucher, Manheim, PA (US); Edward Richard Garrity, Jr., Lancaster, PA (US); Donald Walter Bartch, York, PA (US); James Francis Edwards, Lancaster, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 52 days.

(21) Appl. No.: 10/017,020

(22) Filed: Dec. 14, 2001

(65) Prior Publication Data

US 2003/0111949 A1 Jun. 19, 2003

(51) Int. Cl.[7] ..... H01J 29/80
(52) U.S. Cl. ..... 313/407; 313/402
(58) Field of Search ..... 313/407, 404, 313/402, 403, 405, 406, 408

(56) References Cited

U.S. PATENT DOCUMENTS 4,745,328 A * 5/1988 Strauss ..... 313/402
5,644,192 A * 7/1997 Ragland, Jr. ..... 313/402
2002/0079810 A1 * 6/2002 De Paolis et al. ..... 313/407
2002/0135288 A1 * 9/2002 De Marino et al. ..... 313/407
2002/0145375 A1 * 10/2002 LaPeruta et al. ..... 313/402

FOREIGN PATENT DOCUMENTS

JP 06267446 A * 9/1994 ..... H01J/29/02

* cited by examiner

*Primary Examiner*—Nimeshkumar D. Patel
*Assistant Examiner*—German Colón
(74) *Attorney, Agent, or Firm*—Joseph S. Tripoli; Joseph J. Laks; Carlos M. Herrera

(57) ABSTRACT

The present invention provides a focus mask and frame assembly for a cathode ray tube. The cathode ray tube includes an evacuated envelope enclosing a luminescent screen, a focus mask, and a support frame having at least two long sides for supporting the focus mask between the electron gun and the screen within the cathode ray tube. The focus mask has an active array area formed of a plurality of strands and cross wires separated by an insulating material and defining a plurality of focusing apertures within the array area. A border is attached to the strands opposite the insulating material along the upper and lower outer edges of the active array area. The borders extend into the active array area such that the cross wires overlie a portion of the borders and the borders form focusing apertures with the strands along the upper and lower edges of the array.

7 Claims, 2 Drawing Sheets

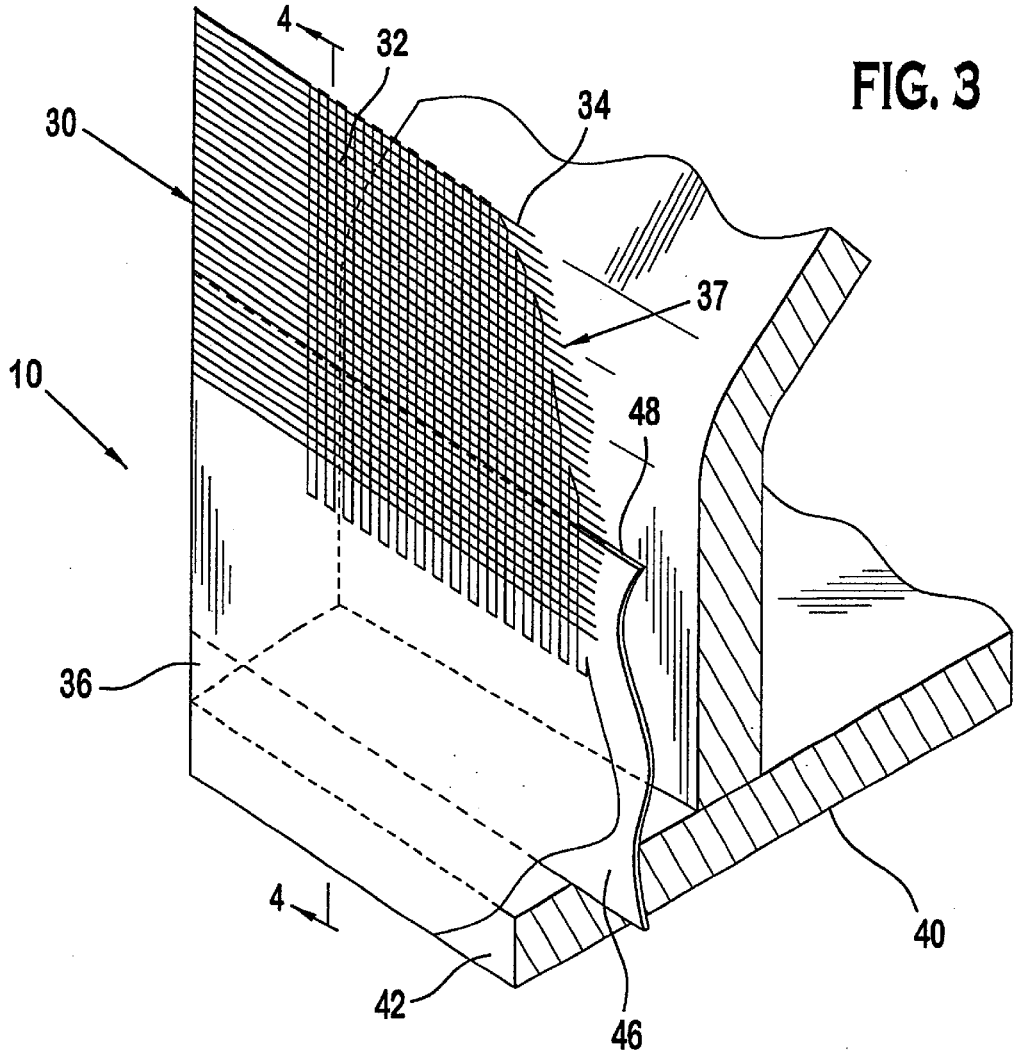
FIG. 3
FIG. 4
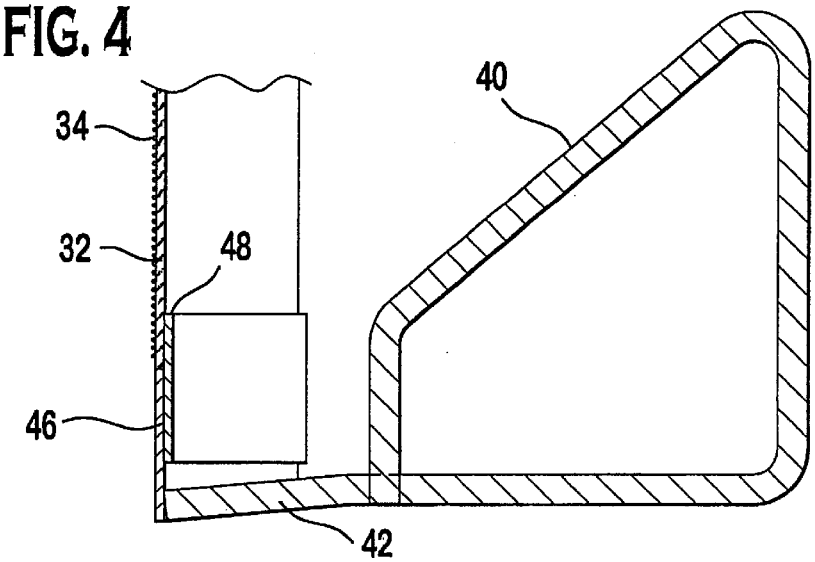

CATHODE RAY TUBE HAVING A FOCUS MASK AND SUPPORT FRAME ASSEMBLY WITH AN IMPROVED BORDER

FIELD OF THE INVENTION

The present invention relates to cathode ray tubes having focus masks, and more particularly to a tube having a focus mask with a mask structure and support frame with an improved border.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

Another type of shadow mask is a focus mask having a mask structure comprising an array of parallel conductive strands that are tensioned onto a mask support frame and an array of parallel conductive cross wires. The strands terminate at top and bottom with an etched solid border that is welded to the support frame. The solid border of the mask serves as an optical edge for forming the black surround of the matrix which in turn defines the perimeter of the screen array of the tube screen. The cross wires are placed perpendicular to the strands and separated from the strands by an insulator. The two arrays of conductors form apertures, or mask openings, between the solid borders called the active array area. Different high voltages are applied to each array of conductors, thereby providing an electric magnifying lens, or focus lens, for accelerating and focusing the electron beam in each of the mask openings of the active array area.

The cross wires are typically applied to the screen side surface of the strands and overlie at least a section of the solid borders of the mask near the active array edges. It has been found that the solid borders of a focus mask tend to prevent proper distribution of the insulator and necessary insulating capabilities between the two arrays of conductors near the active array edges where the cross wires overlie the solid borders. Improper insulation of the strands from the cross wires may lead to arcing between the conductors at one or more places near the active array edges which may result in an electrical short leading to the subsequent failure of the focus mask.

Such problems with the mask solid borders have led to the removal of the cross wires near the solid border region or individually attaching the mask strands to the mask support frame, wherein no solid mask borders are attached to the frame. However, removing the cross wires near the solid border region eliminates focusing apertures along the active array edges which in turn reduces the focusing region of the tube. In addition, individual attachment of the mask strands has been problematic because the strands tend to displace from the pushing action of the weld device during welding. Furthermore, the absence of a solid border is also not desirable because the solid borders serve as optical edges at the top and bottom location of the tube, for proper matrix printing.

It is therefore desirable to provide an improved border for a focus mask for use in a cathode ray tube.

SUMMARY OF THE INVENTION

The present invention provides a focus mask and frame assembly for a cathode ray tube. The cathode ray tube includes an evacuated envelope enclosing a luminescent screen, a focus mask, and a support frame for holding the focus mask in register with the screen. The focus mask includes a plurality of parallel spaced-apart strands and a plurality of spaced-apart cross wires separated from the strands by an insulating material and oriented substantially perpendicular to the strands forming an active array area of focusing apertures. A novel border is attached to the strands opposite the insulating material and extends into the upper and lower outer edges of the active array area wherein the cross wires overlie a portion of the borders.

BRIEF DESCRIPTION OF THE DRAWINGS

The invention will now be described by way of example with reference to the accompanying figures of which:

FIG. 3 is an exploded perspective view of a corner area of the focus mask assembly as shown in FIG. 2.

FIG. 4 is a cross sectional view of another embodiment of the present invention with the focus mask strands extending across the support frame as taken along the line 4—4 of FIG. 3.

DETAILED DESCRIPTION OF THE INVENTION

Figure 1:
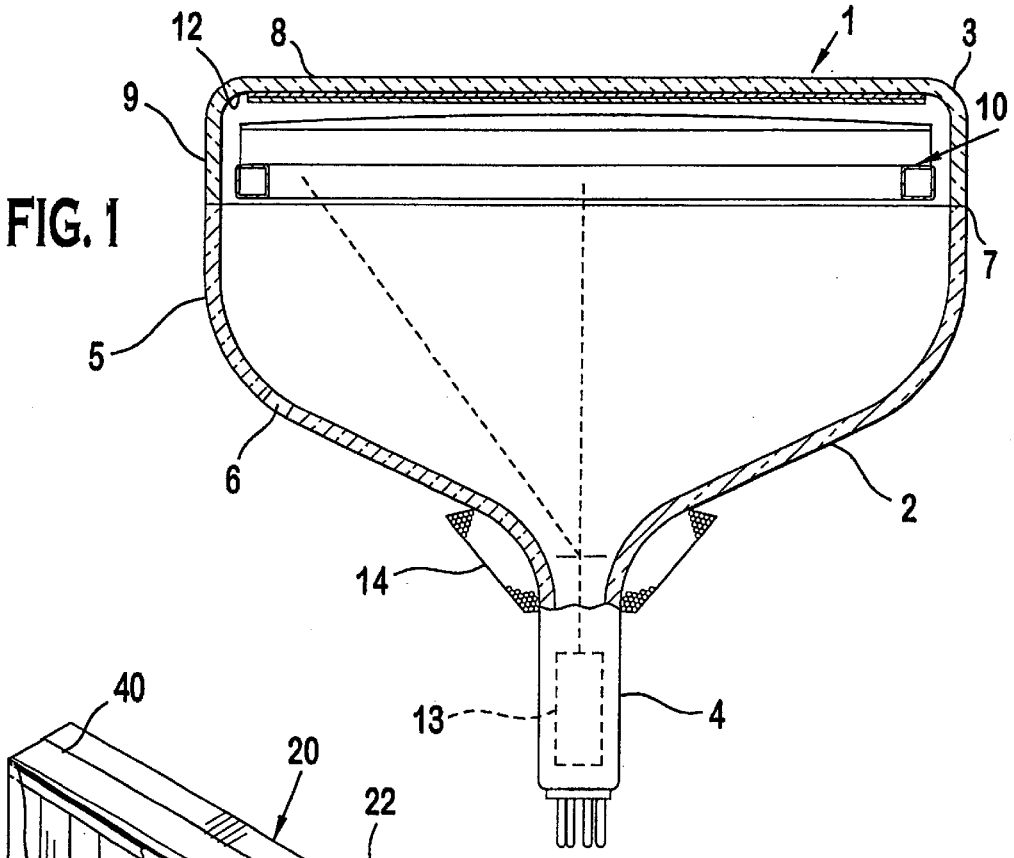
FIG. 1 is a cross sectional view of a CRT containing the improved focus mask of the present invention.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A focus mask support frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the focus mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
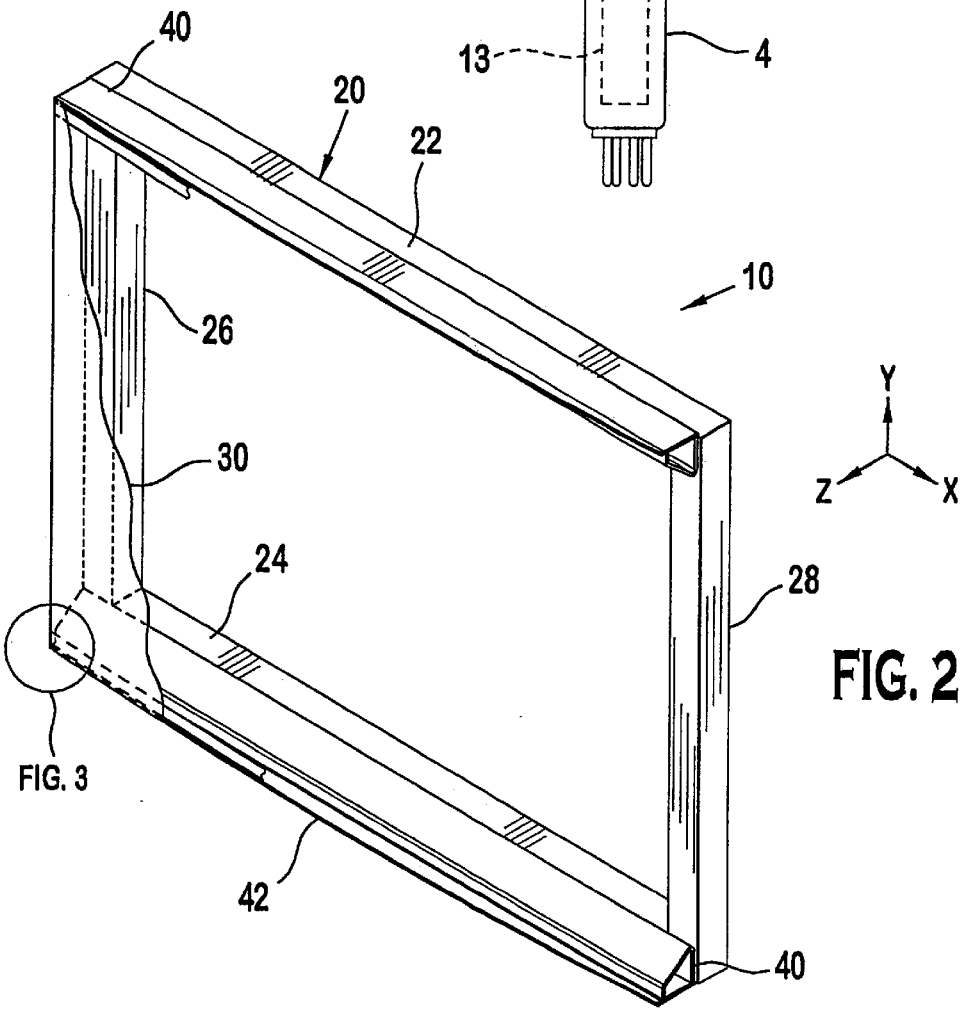
FIG. 2 is a perspective view of a focus mask and frame assembly according to the present invention.

The focus mask support frame assembly 10, as shown in FIG. 2, has a frame 20 which includes two long sides 22 and 24, and two short sides 26 and 28. The two long sides 22, 24 of the frame 20 are parallel to a central major axis, X, of the tube; and the two short sides 26, 28 are parallel to a central minor axis, Y, of the tube. The sides 22, 24, 26, 28 are preferably formed of rectangular tubular material. It should be understood however that other geometry tubular materials or other solid materials could be utilized to form these sides. The two long sides 22, 24 and two short sides 26, 28 preferably form a continuous mask support sub-frame and lie in a common plane generally parallel to a focus mask 30. A pair of opposed support blade members 40 are mounted on the two long sides 22, 24. The mask 30 is supported by edges 42 of each support blade member 40 as will be described below.

Referring now to FIG. 3, an exploded section of one embodiment of the focus mask and support frame assembly 10 is shown. In this embodiment, the focus mask 30 is formed from a thin sheet of conductive material which is etched or otherwise processed to produce a plurality of spaced-apart strands 32 forming a multiplicity of elongated apertured portions therebetween that parallel the minor axis. The opposed ends of the strands 32 terminate at top and bottom solid etched borders 36 which are attached to each of the support blade members 40 at an edge 42, for example, by a wheel-type resistance welder or by other welding methods, such as laser welding. The strands 32 extend parallel to the minor axis, Y, and a plurality of spaced-apart cross wires 34 extend parallel to the major axis, X. The cross wires 34 are coupled to busbars (not shown) on their distal ends to provide tension as well as voltage to the cross wires. The cross wires are separated and electrically insulated from the strands 32 by a suitable insulator such as a lead-based frit (not shown).

The combination of cross wires 34 and strands 32 form a plurality of precisely positioned focusing apertures through which the electron beam passes from the electron gun 13 to the screen 12 during tube operation. These apertures define an active aperture array area 37 between the opposed blade members 40. Novel borders 46 are attached to the strands opposite the insulating material, preferably on the gun facing side of the focus mask 30, near the upper and lower outer edges of the active array area using a conductive adhesive such as potassium silicate, silver flake-doped KASIL or other suitable adhesives for use on a focus mask. The borders 46 includes a well-defined edge 48 which extends parallel to the cross wires and into the active aperture array area 37 below the cross wires 34 so that the cross wires overlie a portion of the borders 46. Since the borders 46 are attached to the strands opposite the insulating material, the insulating material can be applied uniformly on the strands, for example, by a suitable spraying method.

FIG. 4 illustrates another embodiment of the invention wherein the strands 32 do not terminate with solid etched borders 36 but rather continue to extend from the active aperture array area 37 to the support blade member edge 42. In this embodiment, the distal ends of the strands 32 are held in place by the border 46 while the ends of the strands are secured to the edge 42 by a suitable welding means or the like as explained above. As in the embodiment of FIG. 3, the border 46 includes a well-defined edge 48 which extends into the active aperture array area 37 below the cross wires 34 on the gun side of the focus mask 30. With the borders 46 attached to the gun side of the strands 32, the insulating material can be evenly applied to the top, or screen side, of the strands 32 and thus provide proper insulation between the two conductors thereby preventing possible arcing between the conductors and assuring accurate focusing apertures at the upper and lower outer edges of the viewable screen.

Upon conjunction of the faceplate panel 8 with the focus mask 30 during final tube assembly, the focus mask 30 is mounted on studs (not shown) extending from the faceplate panel 8. The electron gun 13 produces an electron beam whose center of deflection is substantially coincident, in effect, with the pathway followed by the light source used in producing and locating the phosphor stripes on the screen 12. With the use of matrix and screening processes known in the art, the border 46 can be used to define the periphery in the matrix process and also define where the phosphor stripes are terminated in the vertical dimension.

The extension of the borders 46 along the opposed ends of the frame 20 also provides an electron shield at the edge of the active electron beam scan region so that undesirable electron scattering from the support blade members 40 during vertical overscan conditions can be reduced.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A cathode ray tube having a focus mask and support frame assembly mounted within the tube between an electron gun and luminescent screen, comprising:

a support frame having two opposed long sides, a focus mask attached to the opposed sides of the frame and having an active array area of focusing apertures between the opposed sides formed by a plurality of strands and cross wires wherein the strands and cross wires are separated by an insulating material, and at least one novel border attached to the strands opposite the insulating material along the opposed sides wherein the cross wires overlie a portion of the at least one novel border and the at least one novel border forms focusing apertures with the strands along the upper and lower edges of the array.

2. The focus mask assembly of claim 1 wherein the strands are elongated metal members that are secured to the opposed sides of the frame and form elongated apertured portions therebetween.

3. The focus mask assembly of claim 1 wherein the novel borders extend from the opposed sides of the frame into the array area to define the upper and lower viewable screen edge of the screen.

4. The focus mask assembly of claim 1 wherein the novel borders are attached to a gun facing side of the focus mask.

5. A cathode ray tube including an evacuated envelope enclosing a luminescent screen, a focus mask suspended in register with the screen by a support frame and having an electron gun side, and a pair of opposed support blades which are parallel to a major axis of the screen and connected to opposed long sides of the frame, comprising:

the focus mask having a plurality of spaced-apart strands, the strands terminating with solid etched borders at its ends, the solid etched borders connecting to the opposed blades, a plurality of spaced-apart cross wires being separated from the strands by an insulating material and oriented substantially perpendicular to the strands, the cross wires and strands forming an active array area of focusing apertures, and novel borders being attached to the strands opposite the insulating material and extending into an active array area of the mask, wherein the cross wires overlie a portion of the novel borders.

6. The cathode ray tube of claim 5 wherein the novel borders are attached to the strands on the gun side of the focus mask.

7. The cathode ray tube of claim 5 wherein the novel border overlies an edge of the solid etched border of the mask.

* * * * *